US005444197A

United States Patent [19]

Flugger

[11] Patent Number: 5,444,197

[45] Date of Patent: Aug. 22, 1995

[54] MUFFLER WITH INTERMEDIATE SOUND-ATTENUATING PARTITION AND METHOD

[76] Inventor: Ray T. Flugger, 2975 Dutton Ave., Unit 3, Santa Rosa, Calif. 95407

[21] Appl. No.: 104,358

[22] Filed: Aug. 9, 1993

[51] Int. Cl.[6] ..... F01N 1/08

[52] U.S. Cl. ..... 181/264; 181/268; 181/275; 181/281; 181/282

[58] Field of Search ..... 181/264, 268, 270, 275, 181/281, 282, 296

[56] References Cited

U.S. PATENT DOCUMENTS

| | | | |
|---|---|---|---|
| 624,062 | 5/1899 | Mattews et al. | 181/268 |
| 2,485,555 | 10/1949 | Bester | 181/268 |
| 4,574,914 | 3/1986 | Flugger | 181/268 |
| 4,809,812 | 3/1989 | Flugger | 181/268 |
| 5,123,502 | 6/1992 | Flugger | 181/264 |

FOREIGN PATENT DOCUMENTS 285604 2/1928 United Kingdom .

*Primary Examiner*—Khanh Dang

*Attorney, Agent, or Firm*—Flehr, Hohbach, Test, Albritton & Herbert

[57] ABSTRACT

A muffler for an internal combustion engine or the like including a casing (21) having an inlet opening (28), an outlet opening (29), a first partition (43) secured in the casing (21) to divide incoming exhaust gases, and a second partition (46) secured in the casing (21) downstream of the first partition (43), which second partition (46) has an opening (39) through which the divided exhaust gases are converged and joined together for exiting the casing (21). The improvement in the muffler assembly which produces both sound attenuation and lower operating back pressure is to provide an intermediate partition (51) secured in the casing between the first and second partitions (43,46) which is formed to permit substantially uninterrupted or unimpeded flow of exhaust gases past the intermediate partition, while a forwardly facing concaved surface (52) reflects sound components in a direction away from the opening (39) in the second partition (46). A method of attenuating sound and reducing back pressure comprising the step of securing an intermediate partition (51) between the first and second partitions (43,46) is provided.

27 Claims, 4 Drawing Sheets

MUFFLER WITH INTERMEDIATE SOUND-ATTENUATING PARTITION AND METHOD

BACKGROUND ART

Considerable effort has been directed toward the development of mufflers which will attenuate the sound components in the exhaust from internal combustion engines without increasing the back pressure caused by the muffler by an amount which significantly diminishes engine performance. My previous U.S. Pat. No. 4,574,914, which is the subject of Reexamination Certificate No. 1599, for example, discloses a muffler which is not only highly effective in attenuating sound, but also even can reduce back pressure when used on racing engines.

The muffler of U.S. Pat. No. 4,574,914 is based upon the provision of a partition assembly which first divides incoming exhaust gases and causes them to flow along opposite side walls of the muffler, thereafter, the partition assembly causes the exhaust gases to join back together for passage through a common opening prior to exiting the muffler. The partition assembly in the muffler of U.S. Pat. No. 4,574,914 produces a low pressure area behind the first partition and is highly effective in attenuating sound by reason of joining together of the divided exhaust gases in front of the opening in the second partition. It is believed that the divergence and subsequent convergence of the exhaust gases results in sound components canceling each other to effect sound attenuation.

FIG. 1 of the accompanying drawing illustrates the muffler assembly of my prior U.S. Pat. No. 4,574,914. Referring to FIG. 1, therefore, the muffler assembly can be seen to include a casing, generally designated 21, which is hollow and has opposed side walls 22 and 23 to which front end wall 24 and rear end wall 26 are secured, preferably by welding at welds 27. Formed in hollow casing 21 are an inlet opening 28 and an exhaust opening 29, which in this case are respectively formed in end walls 24 and 26. Typically, exhaust inlet pipe 31 from an engine header assembly will be secured in opening 28, for example, by welding at 32. Similarly, an exhaust outlet pipe 33 can be welded at 34 to opening 29 in end wall member 26 of muffler housing assembly 21.

Mounted in muffler casing 21 is a partition assembly, generally designated 36. Partition assemblies 36 is formed to first divide incoming exhaust gases, as indicated by arrows 37, to cause divergence of the same toward side walls 22 and 23 of casing 21. In the muffler of FIG. 1, a single stream or flow of gases, or gas pulses, is divided into two substreams of subflows of roughly equal volume. In other assemblies the division of incoming gases can cause them to flow in an annular stream, for example, when the first partition in the assembly is a cone.

Assembly 36 also causes joining of the exhaust gases flowing along opposite walls 22 and 23 so that the exhaust gases come together and pass through opening 39 as a single stream, as indicated by arrows 41. Thereafter, exhaust gases flow out of casing 21 through opening 29 and exhaust pipe 33, as indicated by arrows 42.

Numerous variations on the prior art muffler as illustrated in FIG. 1 have been employed, including multiple diverging-converging partition assemblies in casing 21, as shown in the drawings of U.S. Pat. No. 4,574,914. Moreover, inlet opening 28 is sometimes positioned proximate one of side walls 22 and 23 and a partition used to direct incoming exhaust gases from a side wall inlet location to proximate a middle of the muffler for discharge onto the partition assembly 36.

In the form illustrated in FIG. 1, partition assembly 36 includes a V-shaped first partition 43 having an apex 44 positioned closely proximate the end of exhaust inlet pipe 31. Apex 44 of V-shaped partition 43 also preferably is centered relative to the incoming exhaust flow 37 so as to divide the flow into approximately equal subflows or streams 38.

Partition assembly 36 also preferably includes a second partition means which is preferably provided by a single partition member 46 formed with a central opening 39 therein. It is preferable that member 46 be convergent toward opening 39, although the same joining together or convergence of exhaust gases 41 will be produced if member 46 merely extends straight across casing 21 in an orientation normal to wall 22 and wall 23. It will also be understood that second partition means 46 could be provided by two partition members, each of which extend from an opposite side wall to define, in part and in combination with casing 21, opening 39 therebetween.

In my prior muffler, it is preferable that first partition 43 be substantially imperforate over its width dimension, although a perforation can advantageously be provided, as set forth in my U.S. Pat. No. 5,123,502 in order to ignite any accumulated unburned fuel which may collect behind first partition 43. Moreover, first partition 43 preferably extends over the full height of the muffler assembly.

Similarly, second partition 46 preferably is substantially imperforate, with the exception of opening 39. Second partition 46 also preferably extends over the full height of casing 21. While the muffler of my prior patent preferably has a height dimension which is less than the width dimension of casing 21, in the broadest aspect of the present invention, it is believed that the advantages of reduced back pressure and increased sound attenuation will accrue if casing 21 has equal height and width dimensions, either in the form of a square casing or a cylindrical casing. Moreover, in the broadest aspect of the present invention, it is believed that back pressure reduction and increases sound attenuation will occur even in diverging-converging mufflers as shown, for example, in the prior art muffler assemblies as shown in U.S. Pat. Nos. 624,062 and 2,485,555, as well as the muffler of British Patent No. 285,604.

While the muffler of my prior patent is highly effective and in widespread use in both racing and street vehicles, it is always highly desirable to be able to further reduce muffler back pressure and at the same time to further attenuate the sound components entrained in the exhaust gases. Moreover, since the sound entrained in exhaust gases from internal combustion engines is made up of a wide range of components at differing frequencies, it is highly desirable to be able to tune out or attenuate selected frequencies which are unpleasant to hear.

Accordingly, it is an object of the present invention to further enhance the performance of mufflers which are based upon dividing and then joining together exhaust gases so as to effect sound attenuation.

Another object of the present invention is to provide a method and apparatus for increasing sound attenuation of selected frequencies for mufflers based upon the division of incoming gases and their subsequent direction toward each other to effect sound attenuation.

Still another object of the present invention is to provide an apparatus and method for lowering the back pressure in a muffler employing a divergent-convergent exhaust gas flow inducing partition structure.

The muffler and method of the present invention have other objects and features of advantage which are set forth in more detail in, and will become apparent from, the following description of the Best Mode Of Carrying Out The Present Invention and the accompanying drawing.

DISCLOSURE OF INVENTION

The muffler of the present invention comprises, briefly, a hollow casing having side walls and an exhaust gas inlet opening and an exhaust gas outlet opening formed therein, a first partition secured in the casing and formed and positioned to produce divergence of exhaust gas flow coming from the inlet opening outwardly toward opposite side walls inside the casing, a second partition secured in the casing between the first partition and outlet opening which is formed to define in part a second partition opening, and which is formed to cause the diverging exhaust gases to come together and pass through the second partition opening prior to discharge from the casing outlet opening. The muffler of the present invention further includes an intermediate partition secured in the casing between the first partition and the second partition which is formed for passage of the exhaust gases from the first partition to the second partition in a substantially uninterrupted flow. The intermediate partition further directs a portion of the noise component in the exhaust gases away from the second partition opening and toward the back side of the first partition. The intermediate partition may advantageously be provided with a concave front surface facing away from the second partition opening.

The method of attenuating sound and/or reducing back pressure in a muffler having a partition assembly formed to divide incoming exhaust gases for divergence toward opposite walls and for convergence of the divided gases for flow together to a common opening of the present invention is comprised, briefly, of the step of securing an intermediate partition to extend partially across interior of the muffler a spaced distance in front of the opening and a spaced distance behind a first partition in the partition assembly. The intermediate partition being formed for substantially unimpeded passage of exhaust gases from the first partition to a second partition in the partition assembly while directing sound components away from the opening.

BEST MODE OF CARRYING OUT THE INVENTION

I have discovered that the addition of a sound attenuating or reflecting partition to the muffler assembly of my prior U.S. Pat. No. 4,574,914 will produce significant decreases in muffler loudness, or increases in sound attenuation, without increasing muffler back pressure. In fact, the addition of the sound-attenuating partition to my prior muffler structure not only does not increase back pressure, but actually reduces the back pressure significantly below the already low back pressure levels which were produced by my prior muffler.

Figure 1:
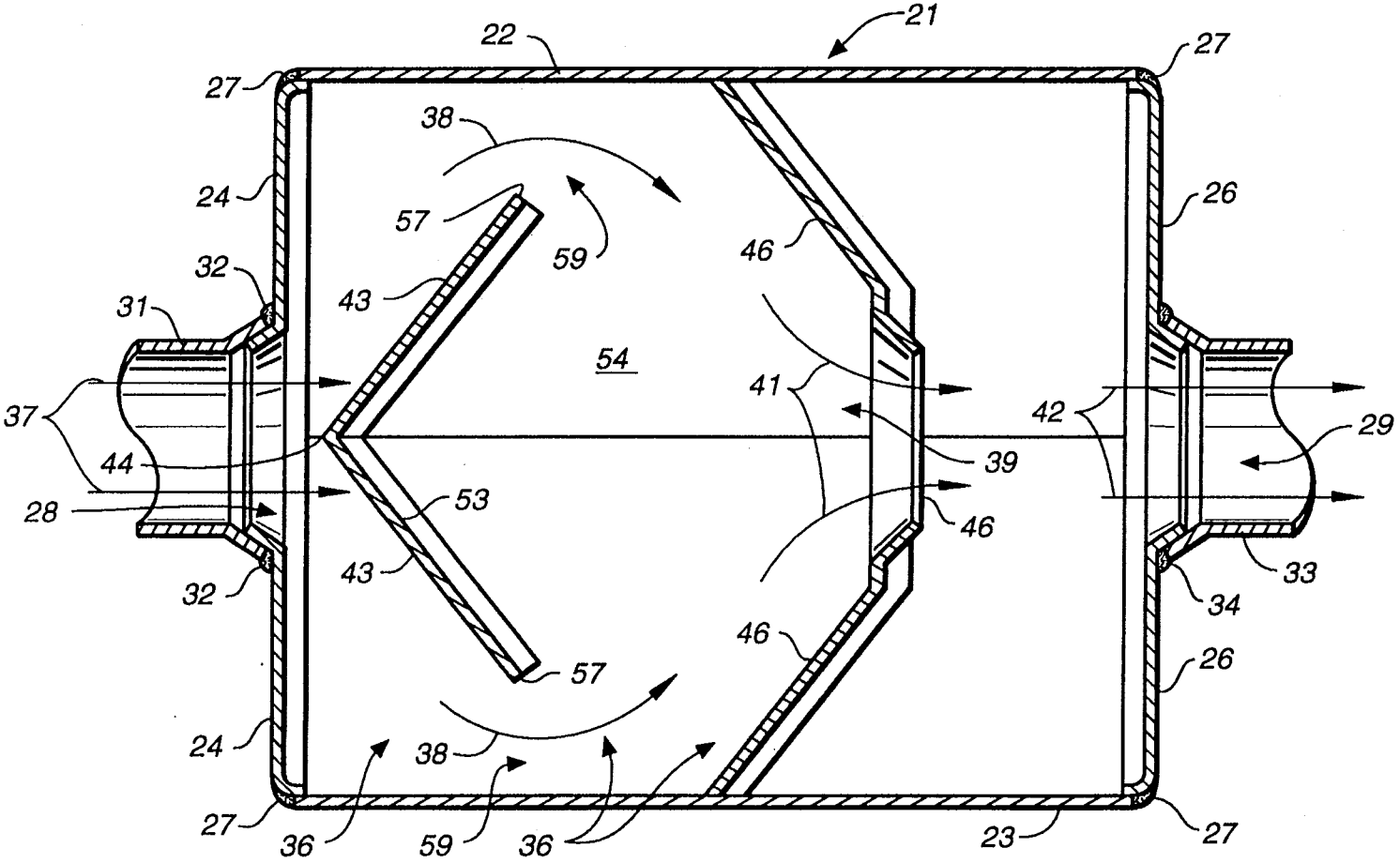
FIG. 1 is a top plan view, in cross section, of a muffler assembly constructed in accordance with U.S. Pat. No. 4,574,914.
Figure 2:
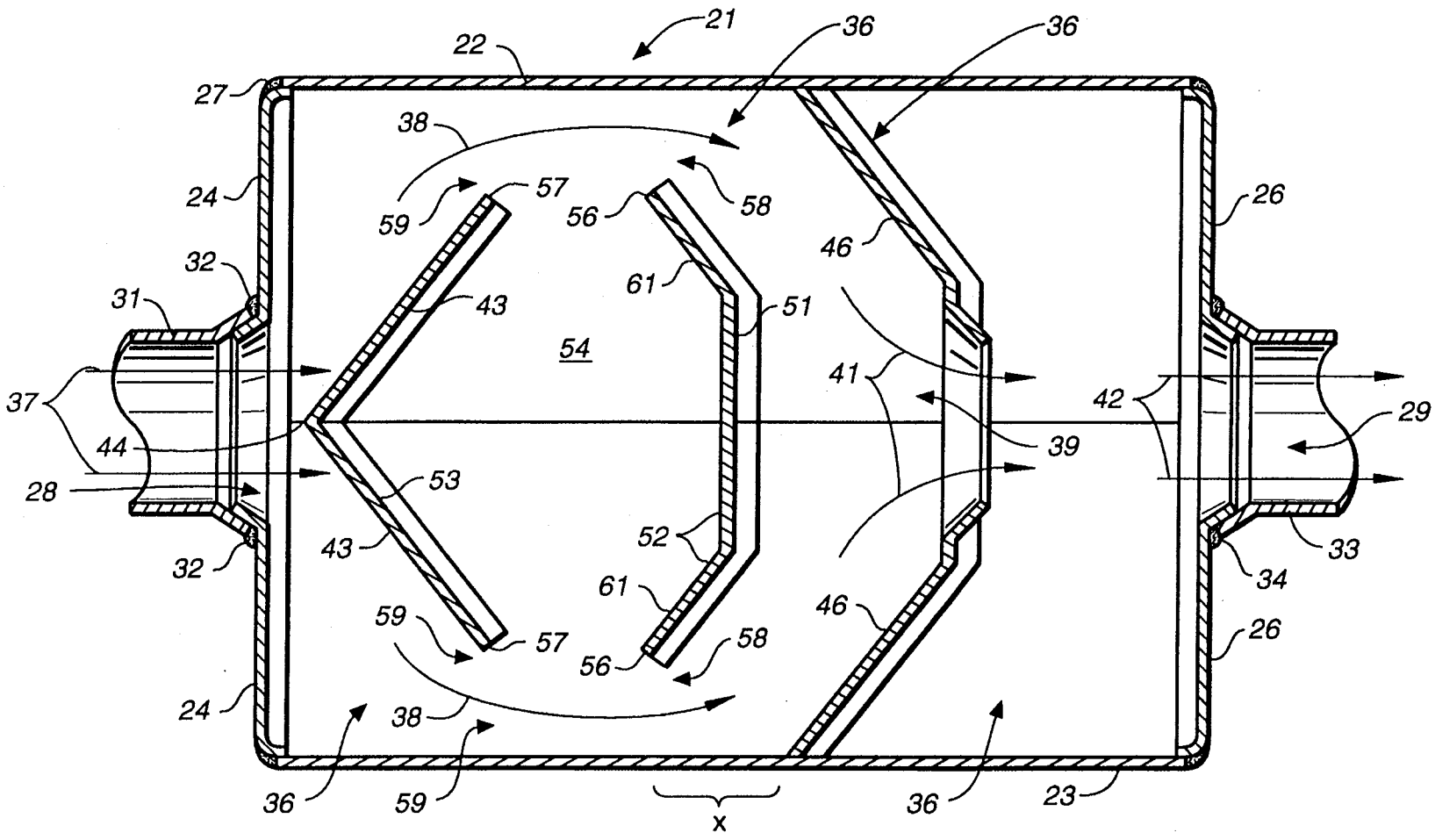
FIG. 2 is a top plan view, in cross section, corresponding to FIG. 1, of a muffler assembly constructed in accordance with the present invention.
Figure 3:
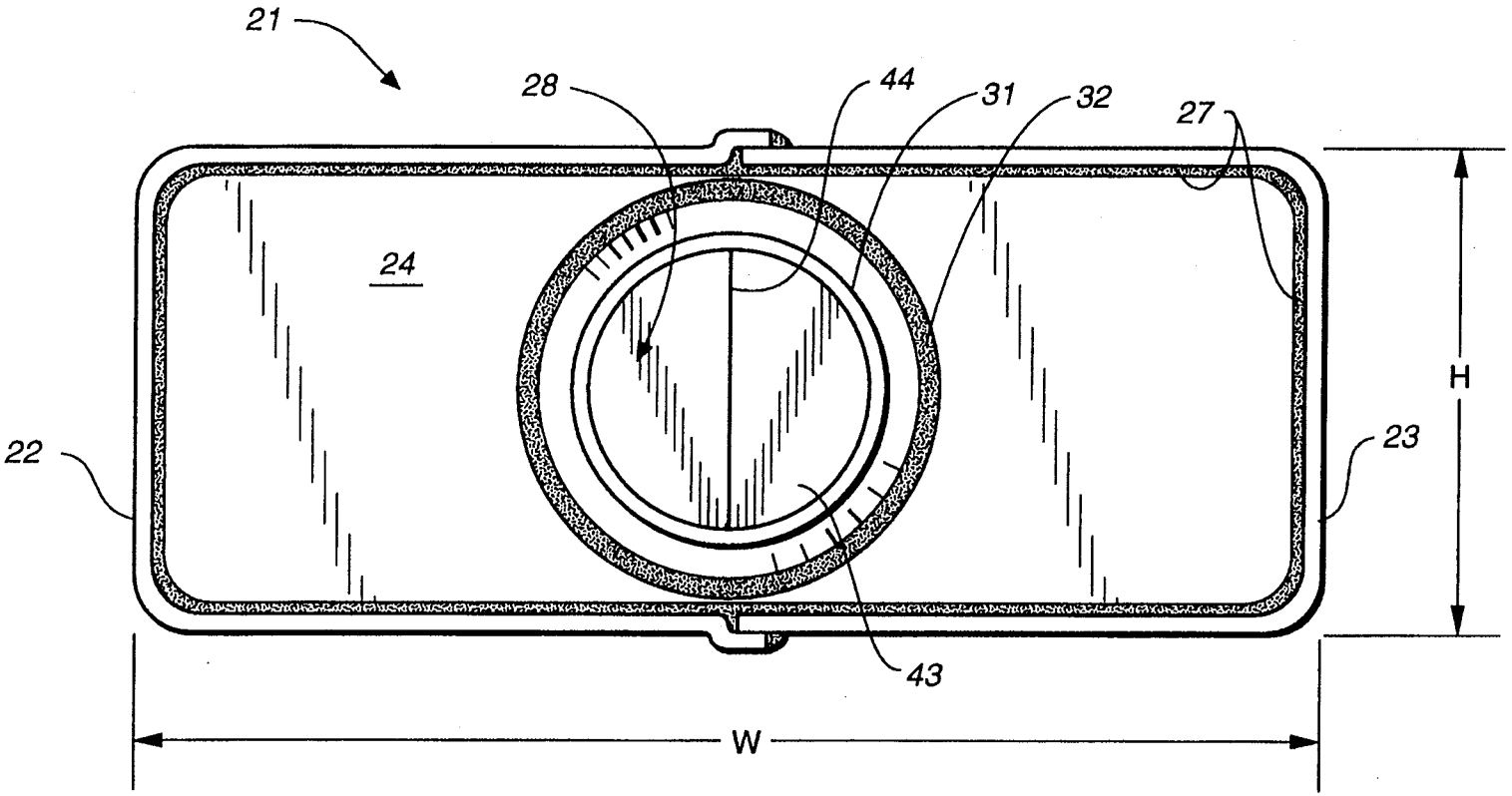
FIG. 3 is an end elevation view of the muffler assemblies of FIGS. 1 and 2.

Since most of the components in the preferred form of the muffler assembly of the present invention are identical to the components in the muffler as illustrated in FIG. 1, the same reference numerals have been used in FIGS. 2 and 3 to identify common components. Nevertheless, since the advantages of sound attenuation are believed to occur in mufflers such as set forth in U.S. Pat. Nos. 624,062 and 2,485,555 and U.K. Pat. No. 285,604, the muffler of the present invention shall not be deemed to be limited in scope to the muffler as defined in my U.S. Pat. No. 4,574,914.

In the muffler assembly of the present invention improved sound attenuation and reduced back pressure can be achieved by securing an intermediate partition 51 in casing 21 between, and a spaced distance from, each of first partition 43 and second partition 46, as best may be seen in FIG. 2. Intermediate sound-attenuating partition 51 is formed to permit flow of exhaust gases 38 from first partition 43 to second partition 46 past the intermediate partition without substantially impeding or interrupting the flow of exhaust gases. Moreover, intermediate partition has a surface 52, which is preferably a concaved or cupped surface which faces toward first partition 43 to reflect or direct at least some of the sound components in the exhaust gases in a direction away from second partition opening 39 so that such redirected sound components will be attenuated before exiting muffler casing 21.

When comparing FIGS. 1 and 2, it will be seen, therefore, that only three changes have been made to the muffler assembly of FIG. 1. First, intermediate partition 51 has been secured in casing 21, and second, second partition 46 has been displaced to the right by the distance x or lengthen casing 21. These two changes produce significant improvements in the performance of the muffler of FIG. 2, as compared to the muffler of FIG. 1. The third change, which was made to attempt to keep the data more comparable, but which may not be critical to the present invention is that casing 21 has been lengthened by the distance x.

Two mufflers of FIG. 1 and two mufflers of FIG. 2 were tested on the same engine, namely, a dual exhaust Chevrolet V-8 350 cubic inch engine of the type employed by Chevrolet in its LT-1 CORVETTE automobiles. The tests were conducted in a dynamometer cell or room, with the sound transducer located only four feet from the end of two exhaust pipes 33. Accordingly, the sound loudness measurements were taken unusually close to the exhaust pipes and include engine noise and reverberations in the dynamometer room. These data, therefore, should only be regarded as data which can be used to compare the two mufflers under similar conditions, rather than data taken in accordance with SAE drive-by standards, or any other standard SAE test. The pressure transducer was located at inlet header pipe 31 immediately in advance of the muffler. Engine speed was advanced in 250 rpm increments and held at each speed long enough for the respective readings to stabilize. The pressure and loudness measurements were taken simultaneously.

Figure 4:
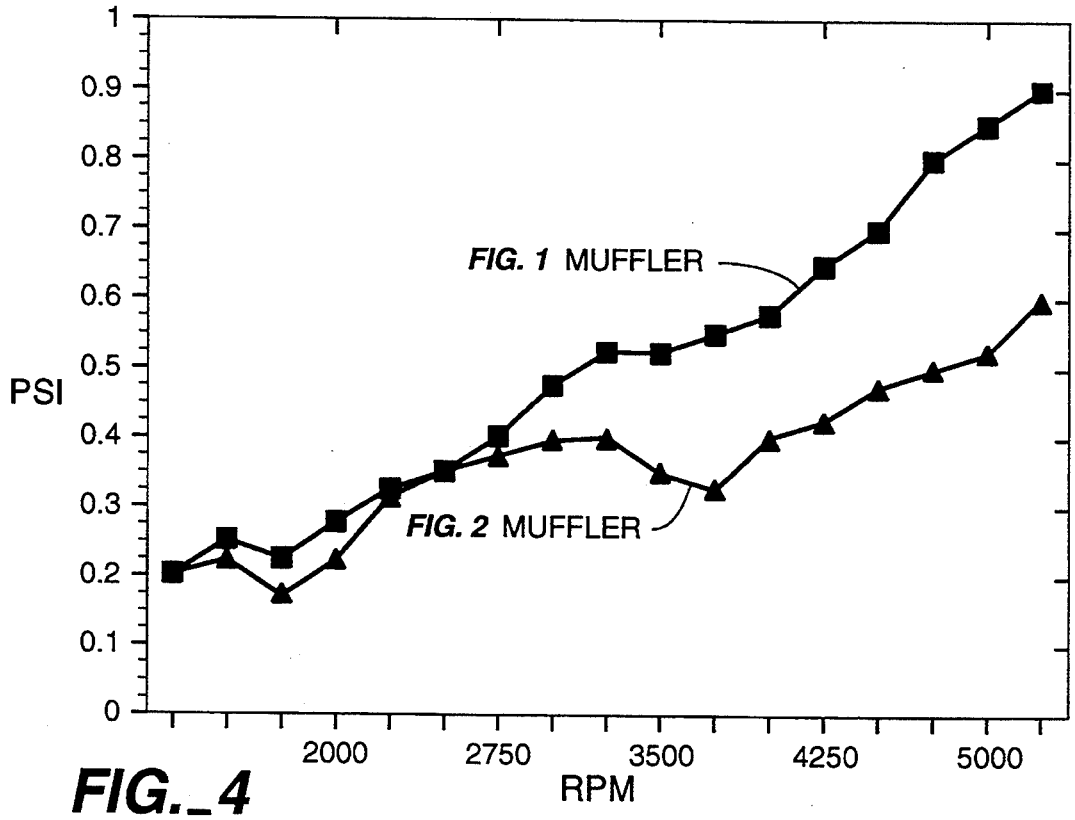
FIG. 4 is a graphic representation of back pressure as a function of engine speed for the muffler assemblies of FIGS. 1 and 2.

As will be seen from FIG. 4, the back pressure produced by the muffler of FIG. 1 initially started at about 0.2 pounds per square inch at about 1500 rpm and increased to about 0.9 pounds per square inch at about 5500 rpm. The back pressure increase was approximately linear, and can be regarded as relatively low, although not less than what one would expect with no muffler on a street engine of this size and tuning. In larger, highly-tuned, racing engines, back pressures below that of a straight pipe can be achieved using the muffler of FIG. 1.

In FIG. 4 it will be seen, however, that the muffler of FIG. 2 started at a back pressure of about 0.2 at 1500 rpm and increased to a back pressure of only 0.6 at 5500 rpm. Thus, there was approximately a $\frac{1}{3}$ reduction in back pressure at high rpm's by changing from the muffler assembly of FIG. 1 to the muffler assembly of FIG. 2. Moreover, some back pressure improvement can be over at a wide range of engine speeds as a result of use of the muffler of FIG. 2.

While the back pressure drop shown in FIG. 4 from the muffler assembly of FIG. 2 produced only minor horsepower improvement in the Chevrolet 350 cubic inch engine, it is believed further that the muffler assembly of FIG. 2 can be used to produce significant horsepower increases in more highly tuned and larger racing engines, particularly at higher rpm's where the engines most frequently operate. Additionally, the lower back pressure created by the muffler of FIG. 2 should produce better fuel efficiency and smoother idling, and in applications such as motor homes using a single exhaust pipe, horsepower increased are expected to be significant.

Figure 5:
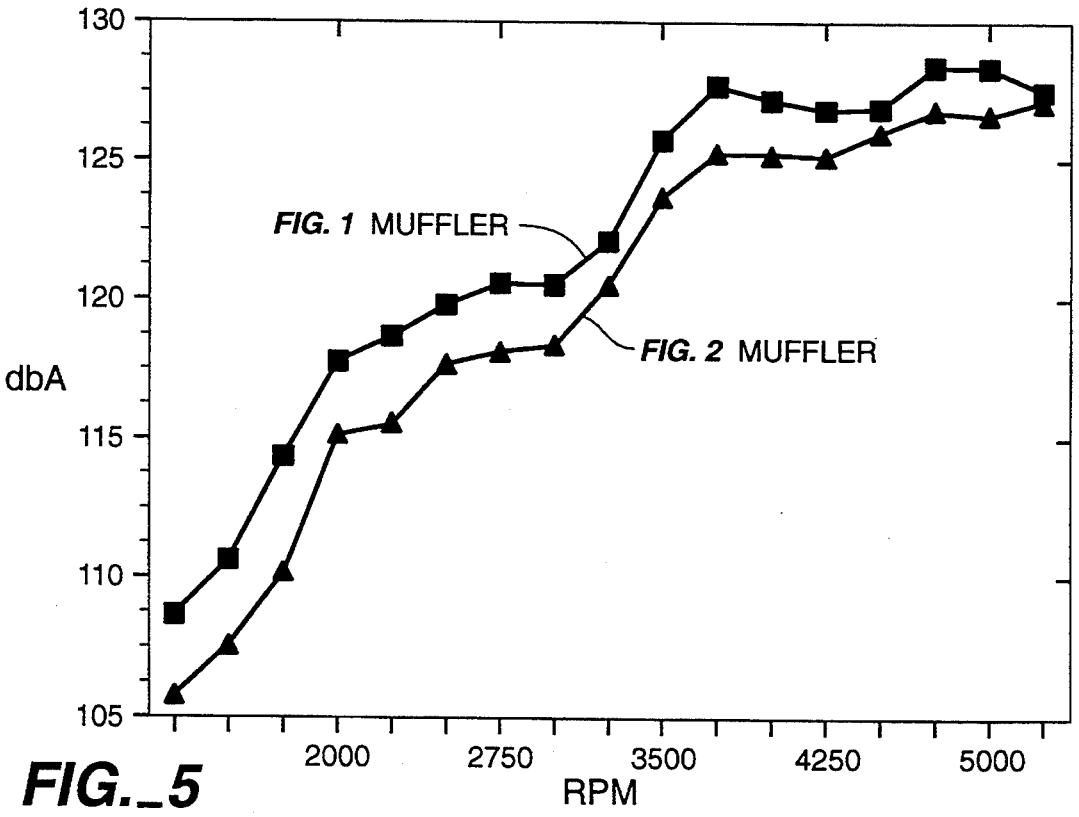
FIG. 5 is a graphic representation of muffler loudness as a function of engine speed for the mufflers of FIGS. 1 and 2, showing data taken simultaneously with the back pressure data of FIG. 4.

In FIG. 5, the relative loudness or decibel reading, on the A, scale for the engine was measured. For the muffler of FIG. 1 the measured loudness range from about 109 dbA to about 128 dbA. When the muffler of FIG. 2 was used, however, the relative loudness was found to range from 106 dbA to 127 dbA over a corresponding range of engine speeds. As will be seen, moreover, the relative loudness was dropped by about 2 to 3 dbA over virtually the entire range of engine speeds. Since the decibel scale is a logarithmic scale, a sound-attenuation improvement of 2 to 3 dbA is regarded as quite significant.

Moreover and very importantly, while a sound spectrum analyzer was not available for use in analyzing the frequencies which produced the overall relative loudness decibel readings of FIG. 5, subjective observation of the sound indicated that the muffler of FIG. 2 had a much more pleasing combination of resultant sound frequencies as compared to the muffler of FIG. 1. As will be discussed hereinafter below, these subjective observations were confirmed when the position and shape of intermediate partition 51 were changed. Although quantitative measurements are not possible without a sound spectrum analyzer, it was clear from subjective or qualitative listening by observers that the frequency spectrum of sound emitted from the muffler of FIG. 2 could be varied by positioning intermediate partition 51 closer or farther away from first partition 43. Similarly, the spectrum of frequencies attenuated could be changed by changing the shape of partition 51, either alone or in combination with the shape of first partition 43. This is extremely important in that it is believed that the shape and location of intermediate partition 51 can be varied to tune the muffler to attenuate undesirable sound frequencies and permit more acceptable frequencies, all without substantially increasing, and in fact decreasing, the muffler back pressure.

Referring again to FIGS. 1 and 2, it is hypothesized that several phenomena account for the performance enhancement produced by intermediate partition 51. First, the sound components entering muffler 21 are initially relatively entrained in and coaxial with the entering exhaust gases. As they impinge upon first deflector or partition 43, however, they become reflected from the first partition and increasingly diverge from or become transverse to the flow of the exhaust gases. As the exhaust gases move between first deflector 43 and partition 46, it is believed that a substantial number of sound components will be reflected inwardly toward partition 51 and cupped or concaved surface 52. In my prior art muffler, these components would simply pass through second partition opening 39, but in the muffler of FIG. 2, they impinge upon partition 51 and are reflected in a direction away from opening 39 toward the back surface 53 of first partition 43. Back surface 53 of partition 43, in turn, tends to reflect the noise components back toward intermediate partition 51. Thus, sound components reverberate back and forth between surfaces 52 and 53 and tend to cancel or attenuate each other in the volume 54 between partitions 43 and 51.

As shown in the drawing, both first partition 43 and intermediate partition 51 can be broadly considered to be cupped, cup-shaped or concave-convex. It will be seen, however, that the concave-convex configuration is approximated by planar surfaces. It is possible, however, for any or all of partitions 43, 46 and 51 to be formed as cylindrical or arcuate or spherical surfaces. The rear-facing, concaved curved surface 53 of such a partition 43 could then be used to focus and cooperate with a front-facing curved surface 52 on intermediate partition 51.

While the sound components travel transversely to the gases, the gases themselves tend to flow against the opposite side walls 22 and 23 of the casing past intermediate partition 51. Although some lateral extension of intermediate partition ends 56 beyond first partition ends 57 may be acceptable, and even advantageous in terms of sound attenuation, it is believed that the pair of intermediate partition openings 58, between ends 56 and side walls 22 and 23, should have an area which is not substantially restricted as compared to first partition openings 59, between ends 57 and casing side walls 22 and 23. Moreover, intermediate partition openings 58 preferably are longitudinally aligned with first partition openings 59 so that exhaust gases forced out against opposite walls 22 and 23 will flow smoothly beyond intermediate partition 51, without partition 51 significantly interrupting or impeding flow. Since the effect of intermediate partition 51 is to drop back pressure in the muffler, it would be acceptable, however, to increase or lengthen ends 56 and reduce intermediate partition openings 58 somewhat in order to achieve further sound attenuation without driving the back pressure up over that of the muffler of FIG. 1. The exact boundaries of such an increase have not been determined at the present time, but as used herein intermediate partition 51 shall be deemed not to substantially interrupt or impede gas flow if the muffler back pressure is not increased significantly over that which occurs in a corresponding muffler of the type shown in the prior art.

It is further hypothesized that the reduction in back pressure in the muffler of FIG. 2 could be the result of any one of three possible sources. First, it will be seen by comparison of FIGS. 1 and 2 that exhaust gas flow 38 in FIG. 1 must bend more immediately in order to proceed around the ends 57 of first partition 43. By contrast, in FIG. 2, the increased casing length, x, which accommodates placement of intermediate partition 51, allows exhaust gases 38 to first be gradually turned at the first partition openings, then flow parallel to side walls 22 and 23 over the distance between the first partition and intermediate partition, and finally gases 38 are bent again by second partition 46 to cause the two exhaust gas streams 38 to join each other as they pass through second partition opening 39. Thus, in the muffler of FIG. 2 the gases are not redirected as radically going around first partition 43.

A second phenomena which may be occurring is that, as exhaust gases 38 pass from first partition ends 57 to intermediate partition ends 56, there may be venturi effect with respect to volume 54 that lowers the pressure in volume 54. One of the known features of the muffler of FIG. 1 is that the pressure behind first partition 43 is substantially reduced as a result of the fluid flow and sound cancellation occurring behind the first partition. This lower pressure has a scavenging effect which causes the muffler back pressure to be relatively low. In the muffler of FIG. 2, some additional scavenging may be resulting from the fluid flow across the gap between partitions 43 and 51.

Finally, the addition sound attenuation or cancellation produced between first partition 43 and intermediate partition 51 may be causing a pressure drop.

The muffler of FIG. 2 has achieved the best performance enhancement vis-a-vis the muffler of FIG. 1, as far as can be determined through limited testing and presently available instrumentation, but other configurations for sound attenuating intermediate partition 51 have been tested.

First, partition 51 has been moved closer to partition 43. In the version shown in FIG. 2 the spacing of intermediate partition ends 56 from first partition ends 57, which produce the data of FIGS. 4 and 5 was about $2\frac{1}{4}$ inches. This spacing, however, was reduced to 2 inches, $1\frac{1}{2}$ inches and 1 inch, respectively. The total sound attenuation, as measured on the dbA, scale was approximately constant at about 2 to 3 dbA, but at 1 inch, high resonance of frequencies occurred which was subjectively very unpleasant to the ear. As the intermediate partition 51 was moved from 1 inch to $2\frac{1}{4}$ inches, the frequency spectrum changed dramatically to the point that at $2\frac{1}{4}$ inches, as shown in FIG. 2, a very pleasing overall sound was produced at virtually all engine speeds, and the overall loudness sound reduction of about 2 to 3 decibels was also achieved. Thus, longitudinal positioning of intermediate partition 51 with respect to the first and second partitions can be used as a frequency tuning method, as well as an overall loudness reduction technique.

It appears from limited testing that intermediate partition 51 should be spaced longitudinally rearwardly of partition 43 by a distance at least equal to the smallest width of first partition openings 59. In the most preferred form second partition 46 is further positioned longitudinally rearwardly of first partition 43 by an amount equal to the sum of the rearward spacing of intermediate partition 51 and the original spacing of partition 46 from partition 43 which would be employed in a muffler of the type shown in FIG. 1.

Second, the shape of partition 51 was altered from that shown in FIG. 2 to a partition identical to first partition 43 only facing in an opposite direction. It was found that both sound attenuation and back pressure decrease resulted, but again the frequency spectrum was not as pleasing as the frequencies which resulted from the configuration of FIG. 2. Nevertheless, shaped changes had an effect on the frequency spectrum. It is believed, for example, that a cylindrical or spherically concaved surface 52 may be even more effective in tuning the frequency spectrum to a pleasing composite, but fabrication of spherically concaved partitions is somewhat more difficult.

In the event that intermediate partition is spherically or cylindrically concaved, it is believed that first partition 43 might advantageously be similarly formed so that the rearwardly facing concave surface 53 cooperates with a concaved front surface 52 on the intermediate partition and a convexed front surface of partition 43 divides the incoming exhaust stream.

Intermediate sound-attenuating partition 51 was constructed as a solid member which extended over the full height of casing 21 between intermediate partition ends 56. Thus, intermediate partition 51 in the test to date has been imperforate, but it is hypothesized that it may not need to be imperforate to achieve many of the advantages of the present invention. Since most of the exhaust gas flow is around partition 51, it is not believed to function to a great degree in directing gas flow. Perforations in partition 51, particularly those which would not allow sound to pass directly through to opening 39 and out outlet 29, may be quite tolerable. The side wing portions 61 of partition 51 may well admit of one or more openings, which would only allow sound components to pass therethrough to be reflected by second partition 46. This use of selectively positioned openings in partition 51 also may be useful as a frequency tuning device.

Moreover, while it is believed that front surface 52 is responsible for most of the sound attenuation effects, it may be that the rear surface of intermediate partition 51 cooperates with the front surface of second partition 46 to effect sound attenuation.

As will be apparent from the discussion of the muffler assembly of the present invention, the method of attenuating sound, and the method of reducing back pressure, in a muffler having a partition assembly formed to divide incoming exhaust gases for divergence and then to converge the gases for flow together through a common opening is comprised of the step of securing a sound-attenuating partition 51 to extend across muffler casing 21 a spaced distance in front of the common opening 39 and a spaced distance behind first partition 43. The sound-attenuating partition 51 is formed for substantially unimpeded passage of exhaust gases 38 beyond partition 51 so that sound attenuation occurs without significant increase of back pressure, and in fact, with a significant reduction of back pressure.

As an additional aspect the method of the present invention includes attenuation of selected frequency components in the exhaust gases by varying at least one of the spacing of intermediate partition 51 from first partition 43, and the shape of intermediate partition 51.

Fabrication of the muffle assembly of the present invention can be accomplished in a conventional manner as has been done for the muffler of FIG. 1. The various partitions can be provided with flanges that are secured to the top and bottom walls of the casing-by spot welding, and the muffler casing and partitions are preferably formed of sheet steel having a gauge which can range between 14 to 20, depending upon the size of the engine being muffled.

What is claimed is:

1. In a muffler including a casing having an inlet opening and an outlet opening, a first partition secured in said casing and formed and positioned to divide incoming exhaust gases for flow in said casing past said first partition, and a second partition secured in said casing downstream of said first partition, said second partition forming in part a second partition opening and said second partition being formed to direct the divided exhaust gases toward each other for flow of substantially all of said exhaust gases through said second partition opening, the improvement in said muffler comprising:

a separate intermediate partition secured in said casing a spaced distance from each of and at a position between said first partition and said second partition, said intermediate partition being formed to permit flow of said divided exhaust gases past said intermediate partition, and said intermediate partition having a surface cupped in a direction facing toward said first partition, said surface being formed to direct sound components in a direction away from said second partition opening.

2. The muffler as defined in claim 1 wherein, said intermediate partition is positioned in said casing in a position producing substantially uninterrupted flow of said exhaust gases from said first partition to said second partition.

3. The muffler as defined in claim 1 wherein, said first partition is V-shaped and diverges from an apex toward opposed side walls of said casing and terminates in first partition ends positioned short of said side walls to define a pair of first partition openings with said side walls for flow of said divided exhaust gases therethrough, said first partition extending substantially completely across said casing in a direction transverse to the direction of division of said exhaust gases.

4. The muffler as defined in claim 3 wherein, said apex is positioned in said casing to divide the incoming exhaust gases into two substreams of substantially equal volumetric flow.

5. The muffler as defined in claim 1 wherein, said second partition opening is proximate a center of the area of said second partition, said second partition is substantially imperforate other than at said second partition opening, and said second partition converges toward said second partition opening.

6. The muffler as defined in claim 1 wherein, said intermediate partition has intermediate partition ends positioned inwardly of opposed side walls of said casing for the flow of exhaust gases therearound, and said intermediate partition is substantially imperforate in front of said second partition opening.

7. The muffler as defined in claim 6 wherein, said intermediate partition extends substantially completely across said casing intermediate said intermediate partition ends.

8. The muffler as defined in claim 1 wherein, said first partition is cupped in a direction facing said intermediate partition.

9. The muffler as defined in claim 3 wherein, said intermediate partition is cup-shaped with said surface being concaved in a direction facing said first partition, said intermediate partition extends in a width dimension in said casing about equal to and aligned with said first partition, said intermediate partition and said casing defining intermediate partition openings therebetween substantially aligned with said first partition openings, said first partition openings each have a width dimension and said intermediate partition is spaced longitudinally in said casing from said first partition by an amount at least about equal to the width dimension of a smaller of said first partition openings.

10. The muffler assembly as defined in claim 9 wherein, said casing has a width dimension greater than a height dimension; and said first partition diverges in a direction toward said width dimension to position said first partition openings proximate opposite sides of said casing.

11. The muffler as defined in claim 1 wherein, said second partition is longitudinally positioned in spaced relation to said first partition by an amount about equal to about twice the longitudinal spacing of said intermediate partition from said first partition.

12. A muffler comprising:

a hollow casing having side walls and an exhaust gas inlet opening and an exhaust gas outlet opening formed therein;

first partition means secured in said casing and formed and positioned to produce divergence of exhaust gas flow coming from said inlet opening outwardly toward opposite side walls inside said casing;

second partition means secured in said casing between said first partition and said outlet opening and formed to define in part a second partition opening of a size sufficient for flow of a majority of said exhaust gases therethrough, said second partition being formed to cause the diverging exhaust gases to come back together and pass through said second partition opening prior to discharge from said outlet opening; and a separate intermediate partition secured in said casing between said first partition and said second partition and formed for passage of said exhaust gases from said first partition to said second partition in a substantially uninterrupted flow, said intermediate partition having a concaved front surface facing away from said second partition.

13. The muffler as defined in claim 12 wherein, said inlet opening has a maximum width dimension;

said first partition divides said exhaust gas flow into at least two subflows;

said second partition causes said at least two subflows to join together for flow through said second partition opening; and said intermediate partition is formed to direct a portion of a noise component in said exhaust gases away from said second partition opening and is spaced from said first partition and from said second partition by a distance at least about equal to one-half of said maximum width dimension of said inlet opening.

14. The muffler as defined in claim 12 wherein, said first partition defines at least in part a pair of first partition openings proximate opposite side walls of said casing, and said intermediate partition defines at least in part a pair of intermediate partition openings substantially aligned with and substantially having the same area as said first partition openings.

15. The muffler as defined in claim 14 wherein, said first partition is a diverging partition having a concaved back surface facing said concaved front surface of said intermediate partition.

16. The muffler as defined in claim 15 wherein, said second partition has a concaved front surface facing said intermediate partition.

17. The muffler as defined in claim 12 wherein, said intermediate partition is substantially imperforate intermediate opposite intermediate partition ends thereof.

18. The muffler as defined in claim 12 wherein, said intermediate partition is spaced longitudinally from said first partition by a distance at least about equal to a diameter of said inlet opening.

19. The muffler as defined in claim 14 wherein, said casing has a height dimension less than a width dimension;

said first partition extends across said width dimension of said casing to define with said casing said first partition openings proximate opposite side walls of said casing;

said intermediate partition extends across said width dimension to define with said casing said intermediate partition openings proximate said opposite side walls in substantial longitudinal alignment with said first partition openings; and said second partition extends across said width dimension and said second partition opening is positioned a spaced distance from each of said opposite side walls inwardly of said intermediate partition openings.

20. The muffler as defined in claim 19 wherein, said inlet opening is positioned in a front end wall of said casing proximate a center of said width dimension of said casing;

said first partition is V-shaped with an apex thereof positioned substantially in longitudinal alignment with said inlet opening;

said second partition opening is positioned substantially in longitudinal alignment with said inlet opening; and said outlet opening is positioned in a rear end wall of said casing substantial in longitudinal alignment with said inlet opening.

21. The muffler as defined in claim 12 wherein, said intermediate partition is formed by two substantially planar, inwardly converging partition portions and a transversely extending substantially planar central partition portion connecting said converging partition portions.

22. A method of attenuating sound in a muffler having a partition assembly therein formed to divide incoming exhaust gases for divergence toward opposite side walls of said muffler and formed to converge the divided exhaust gases for flow together of a majority of said exhaust gases through a common opening before discharge from said muffler comprising the step of:

securing a separate sound attenuating partition to extend across said muffler a spaced distance in front of said common opening and a spaced distance behind a portion of said partition assembly dividing said incoming exhaust gases, said sound attenuating partition being formed for directing said divided exhaust gases in a direction away from said common opening and having a concaved front surface facing away from said common opening.

23. The method as defined in claim 22 wherein, said partition assembly includes a first partition having a V-shaped transverse cross section and a width dimension less than a width dimension of said casing, said partition assembly includes a second partition having said common opening therein and longitudinally spaced in said muffler from said first partition, and said securing step is accomplished by securing said sound attenuating partition at a position intermediate said first partition and :said second partition.

24. The method as defined in claim 22 and the step of:

increasing the longitudinal spacing between said second partition and said first partition by an amount accommodating longitudinal spacing of said intermediate partition from both said first partition and said second partition.

25. The method as defined in claim 24 wherein, said increasing step is accomplished by increasing the length dimension of said casing.

26. The method as defined in claim 22, and the step of:

varying the frequencies attenuated by varying at least one of the spacing between said intermediate partition and said first partition and varying the shape of said intermediate partition.

27. A method of lowering the back pressure generated by a muffler having a first partition therein formed to divide incoming exhaust gases for divergence toward opposite side walls of said muffler and a second partition formed to converge the divided exhaust gases for flow together through an opening defined at least in part by said second partition to have a size sufficient for the flow of substantially all of said exhaust gases therethrough before discharge of said exhaust gases from said muffler comprising the step of:

securing a separate intermediate partition to extend partially across an interior of said muffler a spaced distance in front of said opening and a spaced distance behind said first partition, said intermediate partition being formed for directing said divided exhaust gases in a direction away from said second partition and said intermediate partition having a concaved side thereof facing away from said opening and opposite ends of said intermediate partition being spaced from said side walls of said muffler.

* * * * *